US006162139A

United States Patent [19]

Bassili

[11] Patent Number: 6,162,139

[45] Date of Patent: Dec. 19, 2000

[54] STRING TENSIONING DEVICE

[75] Inventor: John Bassili, Toronto, Canada

[73] Assignee: Deuce Industries Ltd., Toronto, Canada

[21] Appl. No.: 09/299,081

[22] Filed: Apr. 26, 1999

[51] Int. Cl.[7] ..... A63B 51/14

[52] U.S. Cl. ..... 473/557

[58] Field of Search ..... 473/555, 556, 473/557

[56] References Cited

U.S. PATENT DOCUMENTS

| | | |
|---|---|---|
| 3,302,950 | 2/1967 | Hartman . |
| 3,635,080 | 1/1972 | Krueger et al. . |
| 3,913,912 | 10/1975 | Smith . |
| 3,918,713 | 11/1975 | Kaminstein . |
| 4,156,525 | 5/1979 | Parnell . |
| 4,373,721 | 2/1983 | Ray . |
| 4,376,535 | 3/1983 | Muselet et al. . |
| 4,417,729 | 11/1983 | Morrone . |
| 4,620,705 | 11/1986 | Tsuchida . |
| 4,706,955 | 11/1987 | Ngadi et al. . |
| 5,026,055 | 6/1991 | Longeat . |
| 5,269,515 | 12/1993 | Chu . |
| 5,733,212 | 3/1998 | Wise et al. . |
| 5,820,500 | 10/1998 | Raos . |

FOREIGN PATENT DOCUMENTS

| | | | |
|---|---|---|---|
| 34688 | 9/1981 | European Pat. Off. | 473/FOR 175 |
| 0 476 982 A2 | 3/1992 | European Pat. Off. . | |
| 2327803 | 5/1977 | France | 473/FOR 175 |

*Primary Examiner*—Raleigh W. Chiu

[57] ABSTRACT

A string tensioning device for a racquet stringing machine. The device includes a stallable electric motor for providing torque to a tensioning shaft and an electric control circuit for regulating the torque provided by the motor. A manual adjustor is provided to adjust the torque to a preselected desired torque. A gripper is located on the tensioning shaft for gripping the string to be tensioned. In use the motor stalls at a preselected torque permitting the string to be tensioned a predetermined amount.

16 Claims, 5 Drawing Sheets

STRING TENSIONING DEVICE

FIELD OF THE INVENTION

The present invention relates generally to the field of string tensioning devices and in particular to string tensioning devices of the sort that may be used to tension strings of a sports racquet such as a tennis or badminton racquet. Most particularly the present invention relates to string tensioning devices of the sort that use an electric motor to provide tension to the strings being strung into the racquet frame.

BACKGROUND OF THE INVENTION

Racquet stringers have been used and are well known in the art for tensioning racquet strings in sports racquet such as tennis racquet. Each sport racquet has a different preferred string tension, and even different string compositions may require different string tensions for the same racquet. Lastly player preferences also affect the desired string tension so it is not uncommon to need to tension string as close as possible to a desired tension.

Historically, the racquet stringers were of the simple type having a swing lever and a counterweight mounted movably on the swing lever, in an arrangement commonly known as a drop weight. Examples of this may be found in U.S. Pat. Nos. 3,302,920 and 5,269,515. In these devices, to tighten a string to a specified tension, the operator secures the movable weight on the lever at a specified distance from the fulcrum. The operator then clamps the string on a rotatable wheel coaxial with the fulcrum of the lever and swings the lever against the tension of the string, allowing the pull of gravity on the weight to tension the string in a controlled manner.

However, this type of simple device has two important disadvantages. Firstly, to achieve the correct tension, the swing lever must come to a horizontal resting position against the counter pull of the tension string. Any deviation from the horizontal decreases, in an uncontrolled manner, the tension being applied to the string. Typically it is very difficult to achieve the required tension exactly at a horizontal position of the swing lever. Secondly, the heft of the movable weight and the length of the swing lever create an unwielding implement that needs to be continually manipulated out of the way by the operator during the stringing of a racquet. This promotes operator fatigue as well as creating an obstacle to the free rotation of the racquet being strung. Such free rotation is desirable to allow easy access to the holes on the head of the racquet through which the string must be weaved.

More recently there have been proposed more sophisticated stringers which utilize an electrically driven motor to tension the string. The electrical motor provides the force for the tensioning of strings replacing the drop weight. A variety of configurations have been utilized to tension a string to a specific desired tension. For example, some of the prior art teaches the use of a slipping clutch adapted to slip at a predetermined load as in European patent 00476982. In other cases, the motor is de-energized by the tripping of a switch when the preselected tension is applied to the string simultaneously with the brake being engaged to hold that specific tension (U.S. Pat. No. 3,918,713). Most recently, sophisticated electrical machines including built-in microprocessors have been developed. In one example, the microprocessor compares in each instant the tension on the string to a previously preselected reference tension. Depending upon the results of the comparison, the motor will be engaged or relaxed (U.S. Pat. No. 5,733,212).

Regardless of the approach, electrical machines have, until now, been complex and quite expensive to produce. The reason for this complexity is that the prior art electrical machines have required various and ancillary components such as a clutch to prevent over tensioning the string, a spring loaded element to deflect under tension to cause tripping of a limit switch, or sophisticated electronic circuitry to continually poll sensors and to compare the tension of the string against the preselected tension. The ease of operator use of an electrical machine has therefore come at a substantial price.

Aside from the difficulties associated with the means of tensioning taught by the prior art stringing machines, the actual means of engaging a string as it is tensioned has also had a number of disadvantages. Solid winch elements have had the disadvantage of requiring that the string be wrapped and lapped several times around their perimeter to insure that sufficient friction is provided to prevent the string from slipping as it is pulled. Split pulleys or winches have required that their surfaces be dressed with a rough finish to prevent the string from slipping as it is squeezed between the tightened jaws. The application of this rough finish adds to the cost of production of the winch element and because the finish is applied to a rigid metal or plastic surface, it can cause nicking and damage to the string when squeezing it tightly. Another popular means of engaging the string involves a clamp that reciprocates linearly with the string. The clamp comprises two metal jaws that are drawn together gradually by ball bearings as the string is tensioned. Although this clamp works effective in engaging the string its production costs are comparatively high and far exceeds that of simple circular winch elements.

SUMMARY OF THE INVENTION

It is therefore an object of the present invention to provide a simplified string tensioning device for use in particular in stringing sports racquet by means of an electrically energized motor. It is a further object of the invention to provide AC current to the electrically energized motor, and to provide relatively simple phase control circuitry to control the amount of power energizing the motor and therefore to control the output torque of the motor. Most particularly, it is an object of the present invention to exploit the potential of a shaded pole motor to rein stalled against a load even at full power without overheating, wherein such durations of stall are more than sufficient to allow the operator of the stringing machine to manually clamp each string after it has been tensioned with for example a flying clamp. The motor that is stalled under power therefore acts as its own brake for the length of time required for the operator to fix the tension of the string by means of a clamp extraneous to the tensioning mechanism.

It is a further object of the present invention to exploit the potential of gear motor assembly to provide controlled mechanical resistance when the motor is rotating by means of external torque applied to the slowest moving shaft in the assembly which may also be referred to as the output shaft of the gearbox. This characteristic of gear motors provides a controlled means for the release of tension from the section of the string between the clamp and the winch after each tensioning operation (i.e. after the motor is de-energized) and obviates the need for reversing the direction of the motor to allow the release of the string from the winch of the tensioning mechanism.

A further aspect of the present invention incorporates a flexible split winch element comprised of urethane resin and a silica sand aggregate. Flexible urethane has the advantage of cradling the string without damaging it even when the split winch element squeezes the string tightly. The silica sand aggregate mixed with the urethane prior to moulding or casting creates a roughness on the surface of the winch element that enhances the friction between the surface of the element and the string and thus increases the capacity of the winch element to engage the string positively during tightening and tensioning.

Therefore, according to the present invention there is provided a string tensioning device for use in association with a racquet stringing machine, said string tensioning device comprising:

a stallable electric motor for providing torque to a tensioning shaft;

an electrical control circuit for the stallable electric motor for regulating the amount of torque provided by the electric motor;

a manual adjustor for the electrical control circuit for setting the amount of torque at a preselected amount; and a gripper on the tensioning shaft for gripping a string to be tensioned while stringing a racquet;

wherein the string can be gripped by the gripper during racquet stringing causing the electric motor to stall at a preselected torque.

BRIEF DESCRIPTION OF THE DRAWINGS

Reference will now be made to drawings which depict preferred embodiments of the invention by way of example only and in which.

DETAILED DESCRIPTION OF THE PREFERRED EMBODIMENTS

Figure 1:
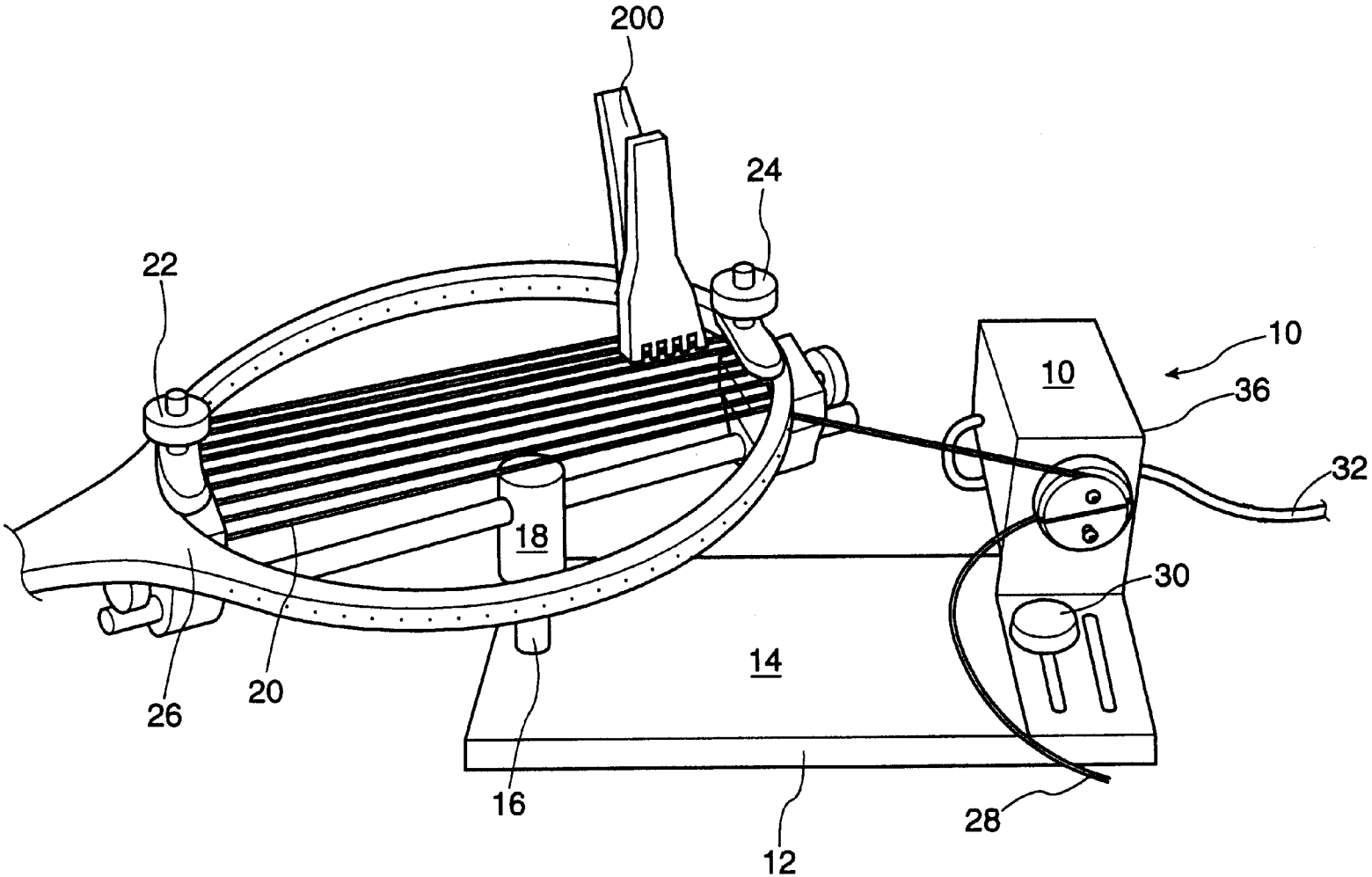
FIG. 1 shows a string tensioner device according to the present invention in position and the racquet stringing machine pulling a string and holding it under tension prior to the installation of a clamp by the operator on the string to hold its tension.

FIG. 1 shows a string tensioning device indicated generally at 10 according to the present invention. The string tensioning device 10 is shown in association with a racquet stringing machine 12. The racquet stringing machine 12 includes a base 14, a racquet supporting post 16 at one end, and a string tensioning device 10 at the other end. The racquet stringing post 16 includes a rotatable cap element 18 having a generally horizontal support member 20 with clamp elements 22 and 24 located at opposite ends of the horizontal member 20. These elements are conventional and will be familiar to those skilled in the art.

Also shown in FIG. 1 is a sports racquet 26 which is being strung with string 28. In the illustrated example the sports racquet 26 is a tennis racquet, but it will be appreciated that the present invention is applicable to stringing machines that may be used with a wide variety of sports racquets including tennis, badminton, racquet ball, squash and other stringed sports racquets.

Turning now to the string tensioning device 10, it can be seen that the string tensioning device 10 is mounted to the base 14 by means of a mounting element 30. The mounting element may be in the form of a knurled knob, to permit the string tensioning device 10 to be removable for ease of transportation. However, the string tensioning device 10 may also be securely non-removably attached to the base 14 if desired (see FIG. 5) by conventional bolts, welding, or the like.

Extending from one end of the string tensioning device 10 is an electrical cord 32 which ends in a plug head (not shown). The electrical cord 32 provides a connection to a standard AC power source, such as a household electrical current.

The string tensioning device 10 also includes an outer housing 36 within which is contained a stallable electrical motor 38. The stallable electrical motor 38 provides torque to an output shaft 40 upon which sits a split winch element 42 which is described in more detail below and shown in FIG. 7.

Turning to the stallable electric motor 38, good results have been achieved with a shaded pole alternating current motor with impedance protection. Such a motor is available from Multi Products of Racine, Wis. and has the benefit that it may stall for extended periods of time without overheating.

Figure 2:
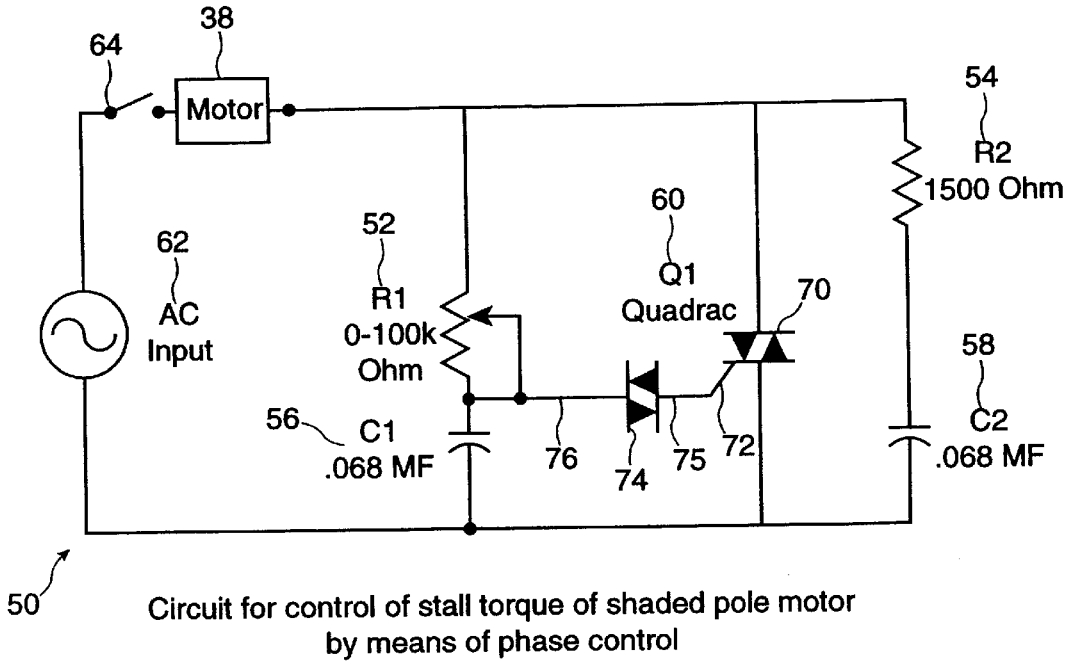
FIG. 2 shows a simple phase control circuit.

Turning to FIG. 2, there is a diagram of an electrical control circuit for the stallable electric motor for regulating the amount of torque provided by the electric motor. The control circuit 50 is preferably in the form of an alternating current phase control circuit consisting of a total of five simple electronic components. In particular there is provided a variable resistor 52, a fixed resistor 54, a first capacitor 56, a second capacitor 58 and a quadrac 60. Also shown are the AC input 62, a switch 64 and the stallable electric motor 38. . As explained in the more detail below, this control circuit 50 is one form of circuit to control the stall torque of the shaded pole motor of the preferred form of the invention. In this circuit, the torque control is provided by means of phase control as set out in more detail below.

Turning now to the operation of the circuit 50, it can be seen that the variable resistor 52 is connected in series with a first capacitor 56. The variable resistor 52 most preferably has a range of 0 to 100 k Ohms. In turn, the first capacitor 56 is most preferably of 0.068 MF. Also shown is the second or fixed resistor 54, which is connected in series to a second capacitor 58. The second resistor is most preferably a 1500 Ohm resistor, with the second capacitor being again a 0.068 MF capacitor. It will also be noted that the fixed resistor and second capacitor are connected in parallel to the variable resistor 52 and first capacitor 56.

Also shown is a transistor triac 70, the main terminals of which are connected in parallel to the variable resistor/first capacitor. A gate terminal 72 on the triac 70 is connected to one main terminal of a transistor diac 74.

In turn, the transistor diac 74 has one main terminal 75 connected to the gate terminal 72, and the other main terminal 76 connected to the variable resistor 52, with the connection of the terminal 76 being at a point in the circuit 50 between the variable resistor 52 and the first capacitor 56. It will be noted that the variable resistor 52 connected in series to the first capacitor 56 and the fixed resistor 54 connected in series to the second capacitor 58 are so arranged in the circuit 50 such that a direct connection not passing through any other circuit elements exists between said first and second capacitors 56, 58, and so arranged that a direct connection not passing through any other circuit elements exists between said variable resistor 52 and said fixed resistor 54.

As shown the phase control circuit 50 is connected to the AC motor 38, such that the AC motor 38 is connected in series with the variable resistor 52 connected in series to the first capacitor 56, in series with the main terminals of the triac 70 and in series with the fixed resistor 54 connected in series to the second capacitor 58.

As a result, when the phase control circuit 50 is subjected to an alternating current in which the voltage across the circuit increases and decreases in amplitude in cyclic fashion, the variable resistor 52 can be used to adjust the amplitude of the voltage at which the transistor diac 74 will trigger the transistor triac 70. In turn, the adjustment of the amplitude at which the transistor triac 70 is triggered controls the current passing through the circuit and therefore controls the power output of the AC motor 38, and the output torque.

Figure 3:
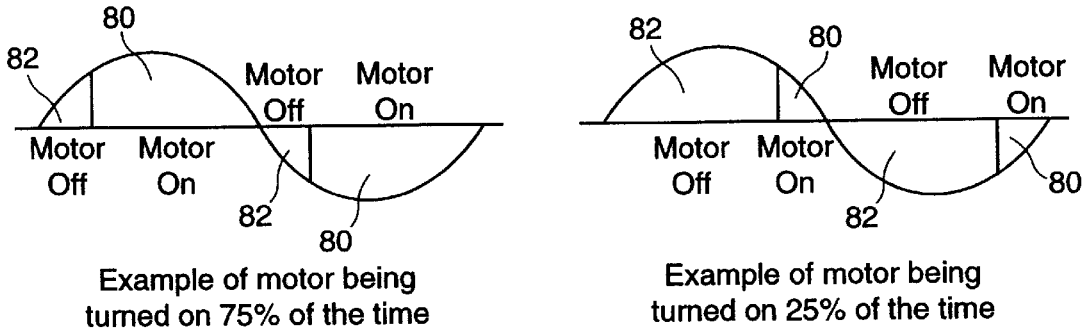
FIG. 3 shows the "ON" and "OFF" conditions created by the phase control circuit at different settings of variable resistors.

Turning to FIG. 3, the power output for the AC Motor 38 is shown at two different settings for the variable resistor 52. One the left hand side, the darkly shaded area 80 represents the motor "on" condition, while the lightly shaded area 82 is the motor "off" condition. This figure illustrates an example of a motor being turned on 75% of the time (i.e. at 75% of maximum torque). On the right hand side, the opposite is true, with the motor being turned on only 25% of the time and generating only 25% of maximum torque.

Figure 5:
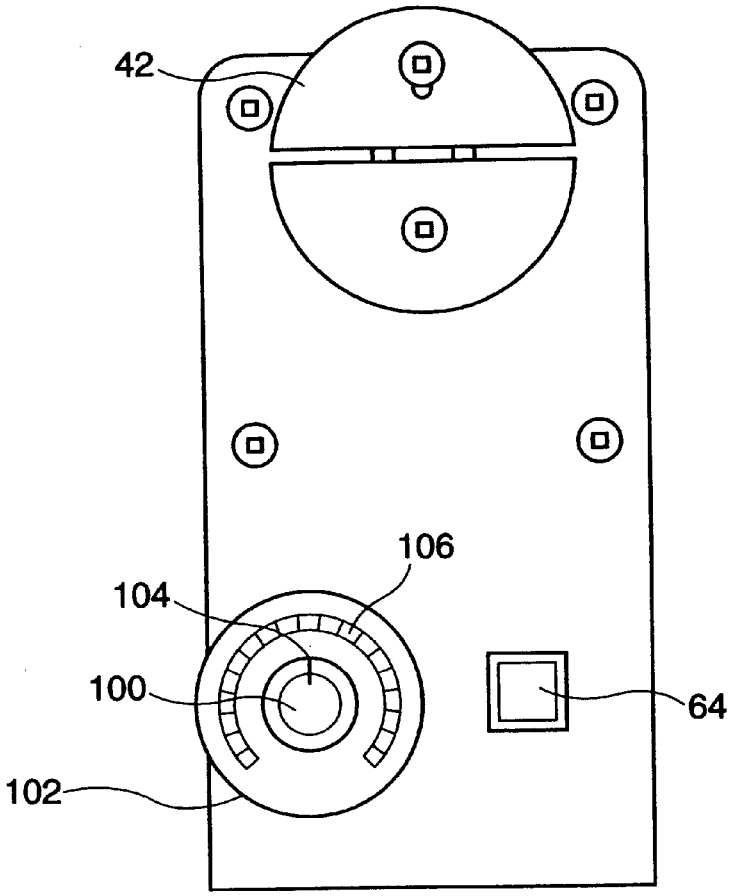
FIG. 5 shows a string tensioning device according to the present invention in side view.

It will now be appreciated that the variable resistor 52 will be provided with a manually actuable knob 100, as shown in FIG. 5, which is associated with a reference scale 102. Most preferably, reference scale 102 will provide a range of weights, which comprehend typical preferred string tension weights, such as in the range of 10 to 90 lbs., and more preferably 30 to 80 lbs. tension for tennis racquets. To use the device, one simply adjusts the variable resistor until a desired reading, such when 60 lbs. on the reference scale 102 is beneath a mark or pointer 104 on the knob 100. Appropriate gradations 106 are preferably provided on the reference scale 102 such that if another tension was required for the next racquet being strung, all that is required is to move the pointer 104 relative to the scale 102 to a new tension, for example 65 lbs.

Initially the reference scale 102 would be calibrated by, for example, inserting a pull scale onto the device, subjecting it to a specific amount of pull, and making the reference scale 102 reflect the tension recorded by the pull scales. Thus, once calibrated the device settings can be changed to select a predetermined desired tension by moving the pointer 104 relative to the scale 102. Of course, due to variation over time, it will be necessary periodically to re-calibrate the device 10 by tensioning a standard pull scale, setting it to a desired force, and aligning the calibration scale to the pointer on the setting knob as outlined above.

Figure 4:
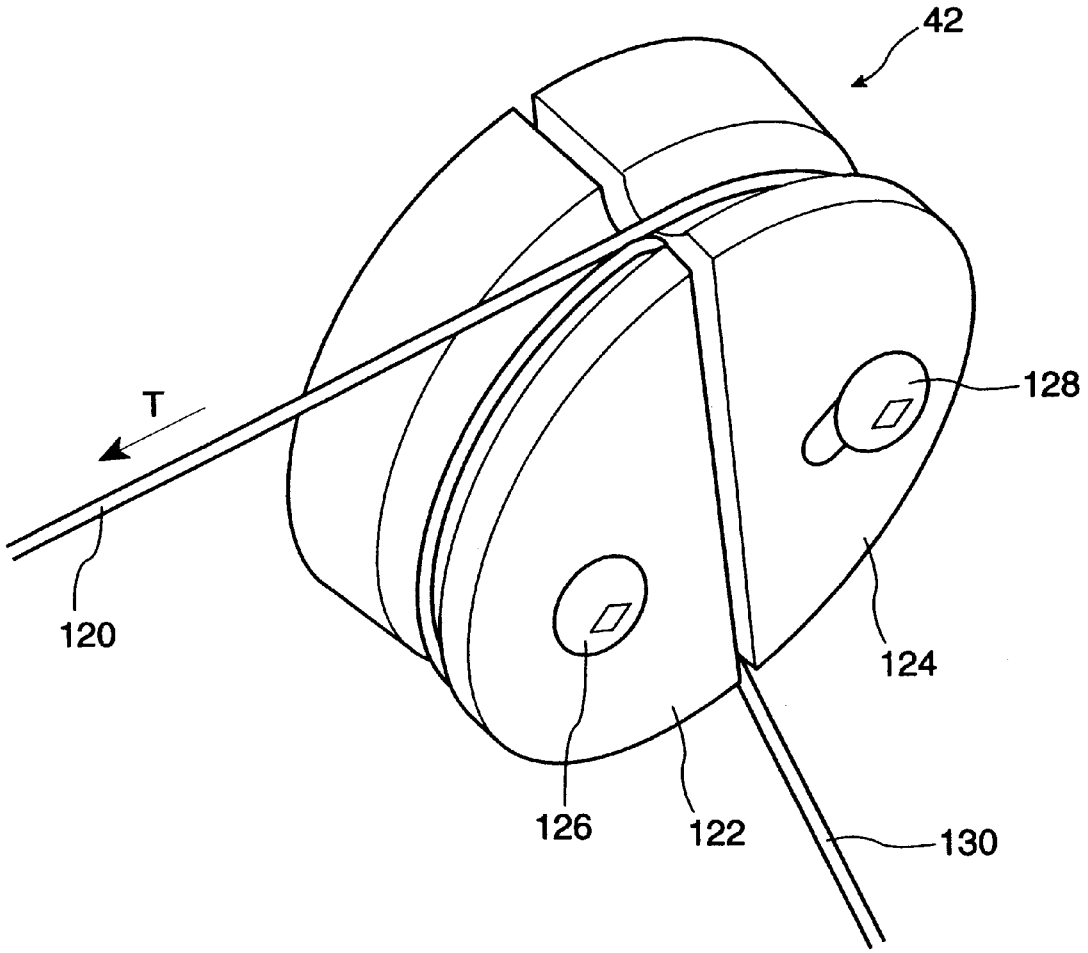
FIG. 4 shows a split winch element with a string looped around its perimeter and pulled between its squeezing surfaces according to an aspect of the present invention.

It can now be appreciated how the present device, once calibrated, can be used in association with racquet stringing machine as shown in FIGS. 1 to 6. Firstly, the racquet is clamped in position in the frame as indicated in FIG. 1. Then a string 28 is threaded through the holes in the racquet in accordance with the racquet manufacturer's stringing specifications. The free end of the string is extended is extended outwardly from the racquet frame and is wrapped around the gripper 42 which is on the output shaft of the string tensioning device 10. The preferred form of gripper element 42 is in the form of a moulded or cast polyurethane split winch element which is rigidly secured to the output shaft 40. A close up of one form of the moulded element 42 is shown in FIG. 4 and includes the string 120, a movable winch element 122 and a fixed winch element 124. A pair of fasteners 126, 128 are shown which are used to attach the winch elements 122 and 124 to a plate (not shown) which in turn is attached to the output shaft 40 of the device 10. As can be seen, the string 120 loops around the two winch elements 122,124 and then is hooped between the winch elements 122,124 with a free end at 130. Tension on the string 120 in the direction of arrow T causes the winch elements to compress together further gripping the string 120. Thus, the more tension that is applied, the more firmly the string 120 is gripped by the gripping element 122, 124.

Most preferably the gripping element is formed from moulded polyurethane which is a soft but durable material which does not mar or otherwise nick the string. In addition, the moulded polyurethane is most preferably a composite which includes a friction increasing agent such as coarse sand or silica. Sand, as a filler is relatively inexpensive compared to the cost of the polyurethane, so using more sand (up to about 50% by weight) reduces the cost of the winch elements. This form of friction increasing agent is gentle and prevents the string from acquiring nicks or the like and yet is effective at increasing the friction between the string and the winch elements. In this manner, secure gripping can be achieved with minimal number of laps on the winch element. Because the winch element needs to be engaged and disengaged many times in the course of stringing a single racquet, reducing the effort involved to grip the string is beneficial to the whole stringing operation.

Figure 6:
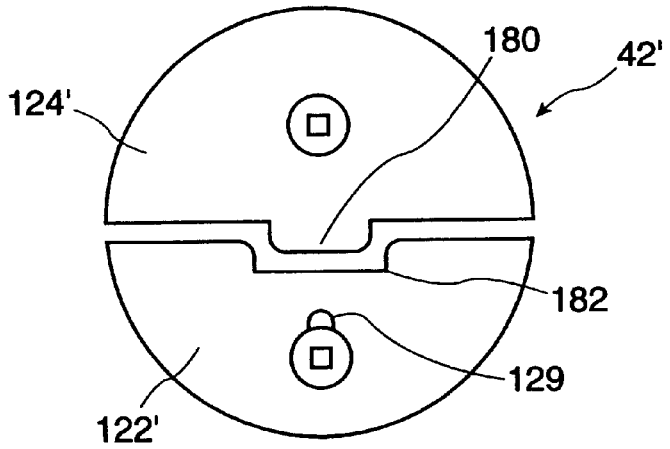
FIG. 6 shows a modified gripping element of the present invention.

Turning now to FIG. 6, a further embodiment of the gripping element 42 is shown at 42'. In this embodiment, all of the elements are the same, except that either of the fixed winch element 124' or the movable winch element 122'are provided with a key 180, and the other is provided with a keyway 182, into which key 180 fits. Sharp corners, which could otherwise nick the string are to be avoided, but the key/keyway combination has the result of more securely gripping the string between the elements 122' and 124'. Further, although a rounded rectangular key/keyway is shown it will be appreciated by those skilled in the art that many different profiles are possible, which would achieve the same results. The softer the polyurethane the sharper the corners can be without nicking the string.

Figure 7:
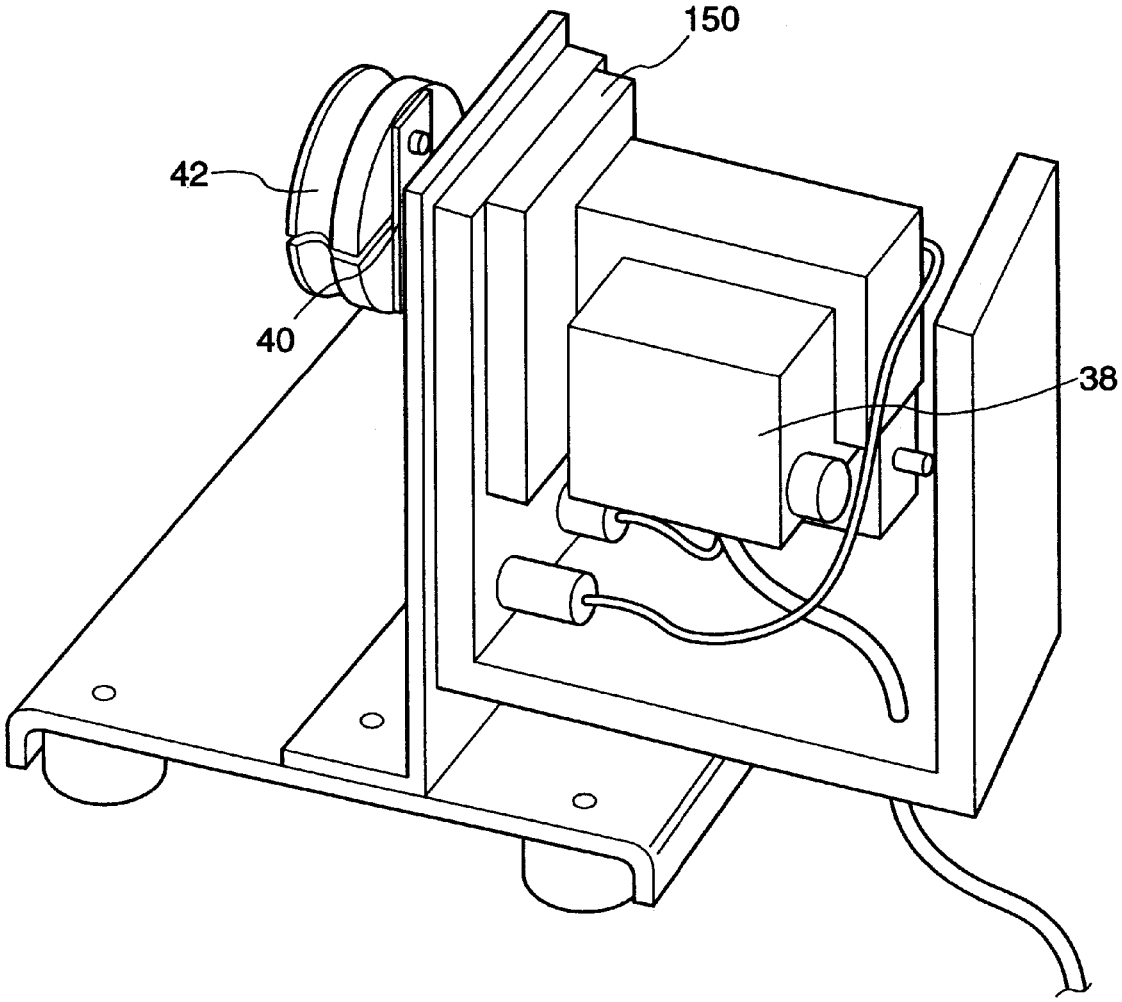
FIG. 7 shows an end view of the string tensioning device of the present invention with the cover removed.

Turning to FIG. 7, the device is shown with the cover removed. Located between the stallable motor and the output shaft is most preferably a gear box 150. The gear box is of a conventional type and simply changes the speed and torque characteristics of the stallable motor to the desired torque range for stringing a racquet such as a tennis racquet. Such a gear box is well known in the art and is therefore not discussed in any further detail herein.

It can now be appreciated how the present device can be used in association with a stringing machine to string a racquet once the device has been appropriately calibrated. The first step is to clamp the racquet in the racquet clamping frame as shown in FIG. 1. Then, the string is weaved through the racquet in the manner taught by the manufacturer of the racquet. This results in the free end extending from the racquet frame which needs to be tensioned. The string is simply wound around and fed between the gripping elements and the motor is then engaged. At or before engaging the motor the preselected tension is set by moving the pointer on the calibration scale to the desired predetermined tension. The motor will then advance the gripping element in a circular fashion until the desired torque is achieved at which point the motor will stall. The operator will easily recognize the stall condition because the winch element is no longer revolving. Then, the operator may use a conventional flying clamp 200, as illustrated in FIG. 1 to clamp the string to maintain tension in the string to maintain tension in the string during the next phase of the stringing operation.

Once the flying clamp 200 has been appropriately positioned to maintain the tension in this racquet string, the motor can be disengaged by tripping switch 64. For the operator's convenience, an indicator light may be provided on the face of the device. The indicator light simply indicates whether the motor is on or off. Also, it is desirable to provide an easily accessible switch 64 for the purpose of energizing and de-energizing the motor. Once the motor is turned off, the resiliency of the racquet string in combination with the inertia of the motor will cause the winch element to slowly begin unwinding. This unwinding step is sufficient to permit the winch element to freely be disengaged from the string without the need for any operator action. The string simply unwinds from the winch element when not being tensioned by the motor. Thus, the free end can be easily removed from the gripping element and threaded back through the racquet frame in the manner specified by the racquet manufacturer. Then, once the free end is brought clear of the racquet frame again, it can be simply and quickly wrapped around the gripping element, the motor engaged and the next section of the racquet string tensioned across the frame. These steps will be repeated, as will be understood by those skilled in the art for both vertical and horizontal string sets until the appropriate number of strings are tensioned in the appropriate positions in the racquet frame.

It will be appreciated by those skilled in the art that various modifications and alterations can be made to the form of the invention without departing from the basic spirit of the invention. For example, although one form of gripping element is disclosed, it will be appreciated that other forms of gripping elements may also yield satisfactory results. Further, while one particular form of electrical control circuit is provided it will be appreciated that other forms of electrical control circuit may also be provided which achieve the same results. Essentially, the desired end result is to have a stalable motor which stalls at a preselected tension in order to permit the racquet string to be tensioned to a predetermined tension in a simple, easy and inexpensive manner.

I claim:

1. A string tensioning device for use in association with a racquet stringing machine, said string tensioning device comprising:

a stallable electric motor having a tensioning shaft, said stalable electric motor providing torque to said tensioning shaft when said stallable electric motor is energized;

an electrical control circuit for said stallable electric motor for regulating the amount of torque provided by said electric motor;

a manual adjustor for said electrical control circuit for setting the amount of torque at a preselected amount; and a gripper on said tensioning shaft for gripping a string to be tensioned while stringing a racquet;

wherein said string can be gripped by said gripper during racquet stringing causing said electric motor to stall at a preselected torque.

2. A string tensioning device for use in association with a racquet stringing machine as claimed in claim 1 wherein said gripper is in the form of a split winch element.

3. A string tensioning device for use in association with a racquet stringing machine as claimed in claim 2 wherein said split winch element includes a fixed portion and a moveable portion and said moveable portion is forced onto said fixed portion by tension in said string to cause said string to be gripped.

4. A string tensioning device for use in association with a racquet stringing machine as claimed in claim 3 wherein said split winch element includes a high friction string contacting surface.

5. A string tensioning device for use in association with a racquet stringing machine as claimed in claim 3 wherein said split winch element is moulded, and a friction increasing agent is added to the material from which the split winch element is moulded.

6. A string tensioning device for use in association with a racquet stringing machine as claimed in claim 5 wherein said friction increasing agent is a coarse sand.

7. A string tensioning device for use in association with a racquet stringing machine as claimed in claim 2 wherein said split winch element includes at least one key and mating keyway to enhance gripping a string therebetween.

8. A string tensioning device for use in association with a racquet stringing machine as claimed in claim 1 wherein said stallable electric motor is an AC motor of the split pole type which is able to stall sufficiently long to clamp a string without damaging the electric motor.

9. A string tensioning device for use in association with a racquet stringing machine as claimed in claim 1 wherein said electrical control circuit is a phase control circuit.

10. A string tensioning device for use in association with a racquet stringing machine as claimed in claim 9 wherein said phase control circuit includes a variable resistor and said adjustor is operatively connected to said variable resistor.

11. A string tensioning device for use in association with a racquet stringing machine as claimed in claim 9 wherein said phase control circuit further includes at least a fixed resistor, a capacitor, a transistor triac, and a transistor diac operatively connected together to control a current passing through said phase control circuit whereby the torque on said tensioning shaft may be controlled.

12. A string tensioning device for use in association with a racquet stringing machine as claimed in claim 1 wherein a position of said adjustor may be set at one of a range of tensions.

13. A string tensioning device for use in association with a racquet stringing machine as claimed in claim 12 wherein said range covers between 10 and 90 lbs. of tension.

14. A string tensioning device for use in association with a racquet stringing machine as claimed in claim 12 wherein said range covers between 30 and 80 lbs of tension.

15. A string tensioning device for use in association with a racquet stringing machine as claimed in claim 1 further including a gear system operatively connected between said motor and said output shaft to place the torque provided to said tensioning shaft within a racquet string tensioning range.

16. A racquet stringing machine comprising:

a base;

a racquet mounting element at one end of the base; and a string tensioning device as claimed in claim 1 at the other end of the base.

* * * * *